US008684676B1

(12) United States Patent
Kirkpatrick

(10) Patent No.: US 8,684,676 B1
(45) Date of Patent: Apr. 1, 2014

(54) CENTRIFUGAL FAN

(76) Inventor: William E. Kirkpatrick, Bozeman, MT (US)

( * ) Notice: Subject to any disclaimer, the term of this patent is extended or adjusted under 35 U.S.C. 154(b) by 766 days.

(21) Appl. No.: 12/952,715

(22) Filed: Nov. 23, 2010

Related U.S. Application Data

(60) Provisional application No. 61/263,945, filed on Nov. 24, 2009.

(51) Int. Cl.
*F04D 17/08* (2006.01)
*F04D 29/26* (2006.01)
*F04D 29/34* (2006.01)

(52) U.S. Cl.
USPC ..... 415/151; 415/206; 416/184; 416/220 A

(58) Field of Classification Search
USPC ..... 415/148, 151, 159, 160, 203, 204, 206, 415/224; 416/182, 183, 184, 198 R, 199, 416/200 R, 204 R, 219 A, 220 A
See application file for complete search history.

(56) References Cited

U.S. PATENT DOCUMENTS

| | | | | |
|---|---|---|---|---|
| 2,350,739 | A * | 6/1944 | Ferre | 416/184 |
| 2,357,618 | A * | 9/1944 | Swift | 416/186 R |
| 2,362,868 | A * | 11/1944 | Upson | 416/184 |
| 4,236,871 | A | 12/1980 | Hirst et al. | |
| 4,265,592 | A | 5/1981 | Carlini | |
| 6,866,480 | B2 | 3/2005 | Canali et al. | |
| 7,284,952 | B2 | 10/2007 | Huang et al. | |
| 7,329,100 | B2 | 2/2008 | Kashiwazaki et al. | |

* cited by examiner

*Primary Examiner* — Edward Look
*Assistant Examiner* — Christopher R Legendre
(74) *Attorney, Agent, or Firm* — MacMillan, Sobanski & Todd, LLC

(57) ABSTRACT

A centrifugal fan that includes an impeller having fan blades with notched tabs extending through slots in a pair of disc shaped base elements with the notches engaging the ends of the slots to secure the fan blades upon the impeller.

17 Claims, 5 Drawing Sheets

CENTRIFUGAL FAN

BACKGROUND OF THE INVENTION

This invention relates in general to air moving devices and in particular to centrifugal fans.

Centrifugal fans include an impeller that rotates about an impeller axis. The impeller draws air or another process gaseous fluid into the fan through an inlet that is parallel to an impeller axis. The air is then delivered by the fan impeller in a direction perpendicular to the impeller axis. The air stream delivered by the fan impeller enters a volute which collects and directs the air stream toward an outlet. Centrifugal fans may have either a single or a double intake, that is, they can draw in air from only one side of the fan impeller or from two opposite sides of the impeller, respectively.

The fan impeller is typically formed of a bladed rotating wheel consisting of a disk shaped base to which fan blades are secured. For a fan with a single intake, the blades are arranged only on one side of the disk shaped base; however, for a fan with a double intake, the blades are arranged on both sides of the base. The fan blades can be arranged in a radial direction or they can be inclined forwardly or backwardly with respect to a rotational direction of the fan impeller. The fan blades often have a streamlined profile, but flat blades, that is, non-streamlined blades, are also known.

Additionally, impellers of centrifugal fans can be of a closed or open type according to whether or not a covering element, commonly called an impeller covering, consisting of a circular frame fastened to a tip of the blades is provided. Fan impellers provided with inclined blades are generally of the closed type in order to increase the bending strength of the blades.

Impellers are typically formed by welding the fan blades to an impeller disc shaped base; however, it would be desirable if the impeller assembly could be simplified to reduce the cost and complexity of fabrication.

SUMMARY OF THE INVENTION

This invention relates to centrifugal fans.

The present invention contemplates a centrifugal fan that includes a fan impeller rotatably disposed within a fan housing. The impeller includes a base having a first disc shaped base element with at least one slot formed therethrough and a second disc shaped base element with at least one slot formed therethrough that is offset from the slot formed in the first base element when the base elements are arranged adjacent to one another. The impeller further includes at least one fan blade that has a notched tab extending therefrom. The fan blade tab extends though the slot in the first base element with the notch engaging an end of the slot. The tab also extends through the slot in the second base element with the second base element secured to the first base element to lock the fan blade in position upon the impeller base.

The present invention also contemplates a method for fabrication of a centrifugal fan that includes providing at least one fan blade and first and second base elements. The fan blade has at least one notched tab extending therefrom and each base element has at least one slot formed therethrough with the slot formed through the first base element being offset from the slot formed through the second base element. The fan blade tab is inserted through the slot formed through the first base element and the fan blade is slid across the first base element with the notch formed in the fan blade tab receiving the first base element. The second base element is then secured to the first base element with the fan blade tab extending into the slot formed through the second base element to form a fan impeller. Finally, the impeller is rotatably mounted within a fan housing.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
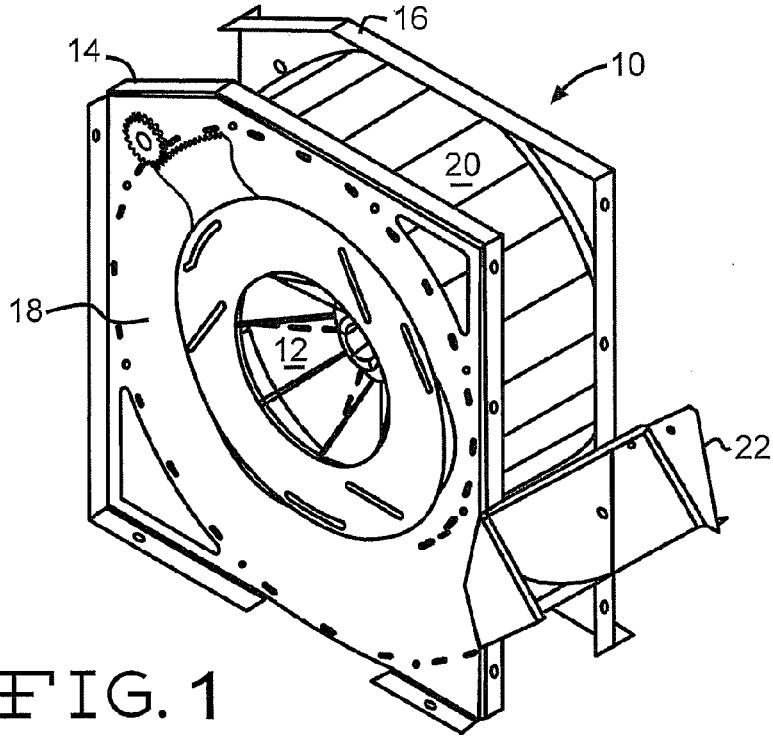
FIG. 1 is an isometric view of a centrifugal fan in accordance with the invention.

Referring now to the drawings, there is illustrated in FIG. 1 a double intake centrifugal fan 10 that is in accordance with the present invention. The fan 10 includes a double impeller 12 mounted between two plane and parallel fan housing sidewalls 14 and 16. The fan also includes a pair of variable sized air intake openings 18, with one of the variable sized openings formed through each of the sidewalls 14 and 16. It will be noted that only one air intake opening 18 is shown carried by the sidewall labeled 14 in FIG. 1; however, it will be understood that a second air intake opening (not shown) is formed through the sidewall labeled 16. The outer edge of the impeller 12 is surrounded by a volute shaped casing 20 that terminates in an outlet duct 22. As the impeller 12 rotates, air, or another process gaseous fluid, is drawn into the fan 10 through the intake apertures 18. The air is accelerated by the fan blades and directed by the casing 20 to the outlet duct 22 where the moving air is discharged from the fan 10.

Figure 2:
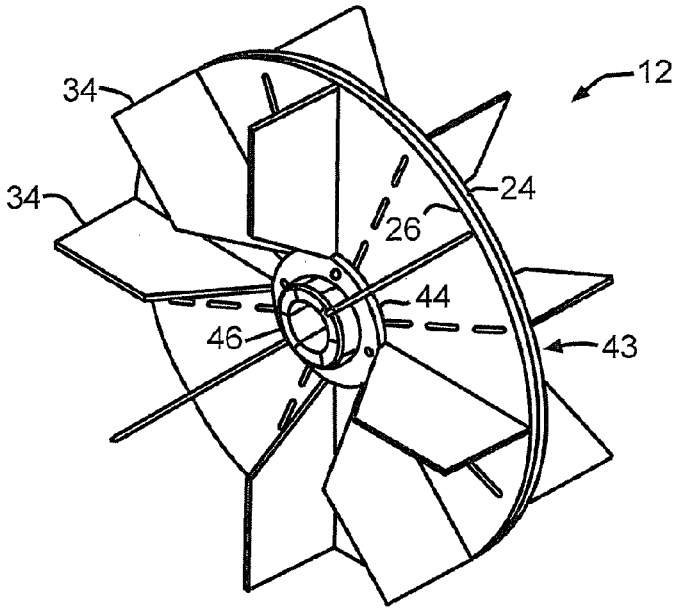
FIG. 2 is an isometric view of an impeller that is included in the centrifugal fan shown in FIG. 1.
Figure 3:
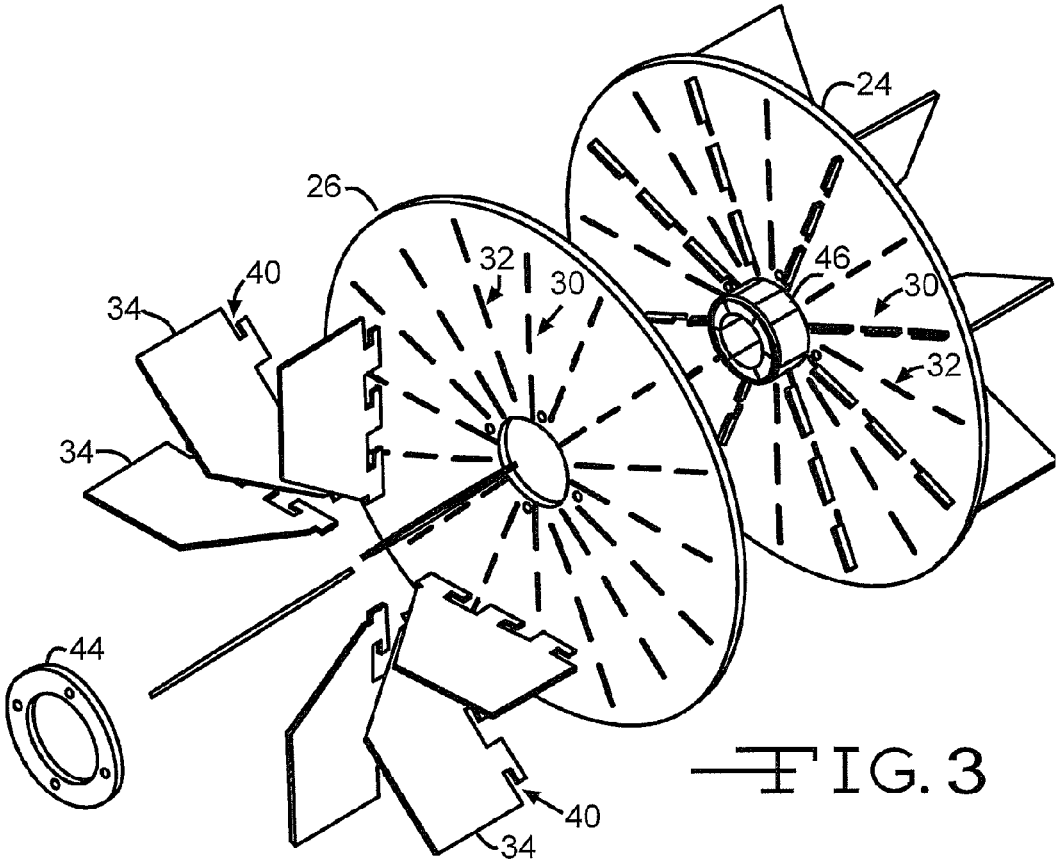
FIG. 3 is an exploded isometric view of the impeller that is shown in FIG. 2.

The impeller 12 is illustrated in FIG. 2 while the assembly of the impeller is best seen in the exploded view shown in FIG. 3. The impeller 12 includes a base having a pair of disc-shaped base elements that are labeled 24 and 26 in FIGS. 2 and 3. A central aperture is formed through each of the base elements 24 and 26. As shown in FIGS. 2 and 3, the base elements 24 and 26 have a plurality of radially extending slots extending through them. The slots have equal lengths; however, as best seen in FIG. 3, a first group of the slots, that are labeled 30, are radially offset toward the center of the base elements 24 and 26 with the innermost slot extending near to the center aperture. A second group of slots, that are labeled 32, are formed with the end slots being equally spaced from the outer and inner edges of the base elements 24 and 26. Additionally, each of the slots 32 included in the second group of slots is circumferentially equally spaced between a pair of slots included in the first group of slots 30, as shown in FIGS. 2 and 3.

Figure 4:
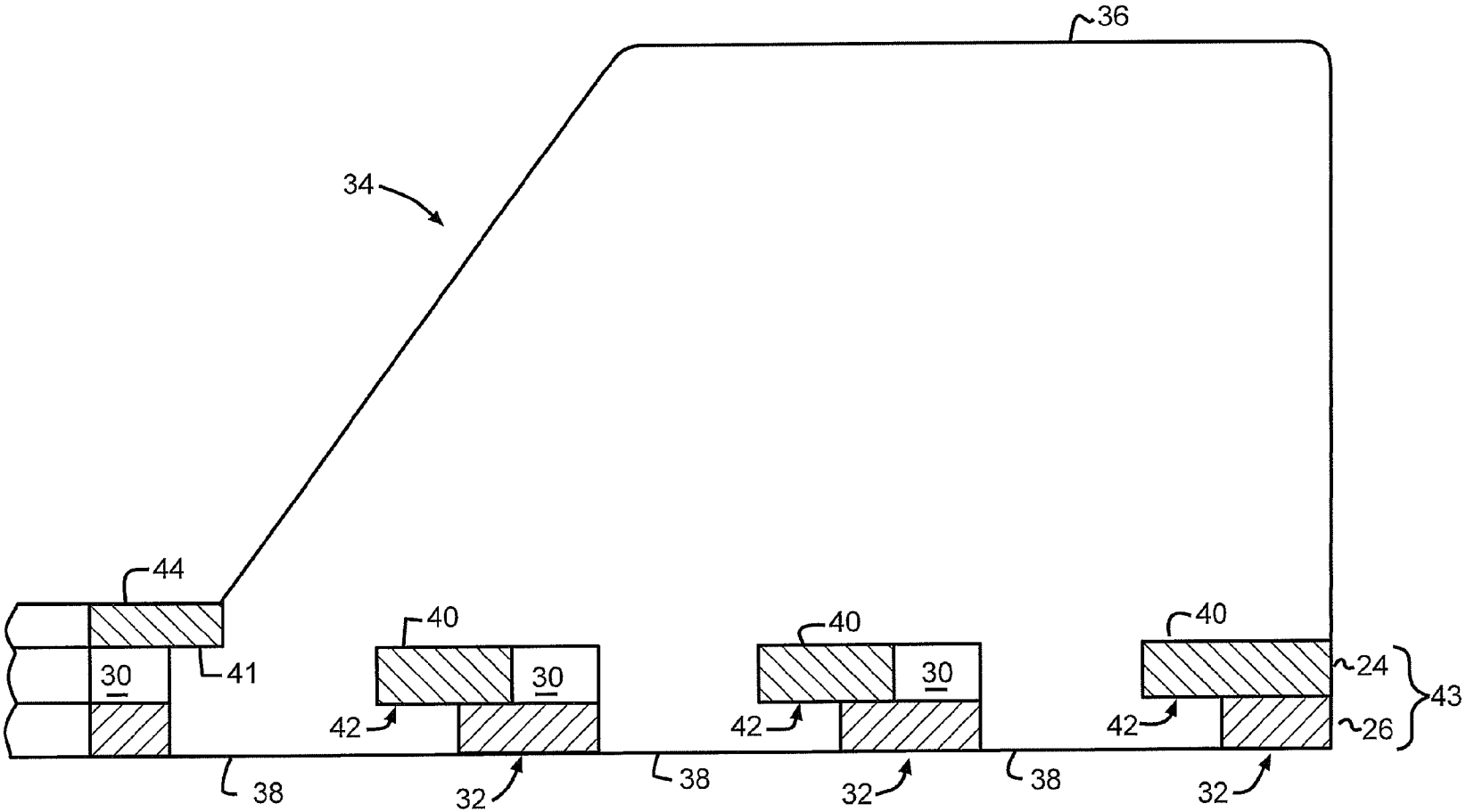
FIG. 4 is a plan view of one of the fan blades included in the impeller shown in FIG. 2.

The orientation of the slots 30 and 32 is best seen in FIG. 4, which includes a partial sectional view of the base elements 24 and 26. As shown in FIG. 4, the upper base element 24 has slots 30 from the first group of slots extending therethrough while the lower base element 26 has slots 32 from the second group of slots extending therethrough. As best seen in FIG. 4, while the slots 30 and 32 are staggered with regard to one another, a portion of the each of the slots 30 included in the first group of slots is aligned with a portion of a corresponding slot 32 included in the second group of slots.

A plurality of fan blades 34 are attached to the base elements 24 and 26. As again best seen in FIG. 4, each of the fan blades 34 includes a trapezoidal shaped blade portion 36. While a trapezoidal shape is shown in FIG. 4, it will be appreciated that the invention also may be practiced utilizing fan blades having different blade portion shapes (not shown). As also shown in FIG. 4, each fan blade 34 includes three tabs 38 that extend from the lower edge of the blade portion 36. While three tabs 38 are shown in FIG. 4, it will be appreciated that the invention also may be practiced with fan blades having more or less tabs than shown. Similarly, while three slots are shown in each of the base elements 24 and 26, the invention also may be practiced with more or less slots formed in each group of slots through the base elements. Generally, there will be as many slots in each group of slots as there are blade tabs 38. As also shown in FIG. 4, an inner notch 40 is formed on the radial outer edge of each of the tabs 38. Additionally, an outer notch 41 is formed on the base of the radially inner edge of the blade portion 36.

The present invention contemplates a novel method for attaching the fan blades 34 to the base elements 24 and 26. The fan blade tabs 32 are inserted through slots 30 formed in the upper base element 24. The fan blades 32 are then slid in an outer radial direction, causing a portion 42 of the upper base element 24 to be received within each of the inner notches 40 formed in the corresponding blade tabs 32. As shown in FIG. 4, the lower base element 26 is attached to the upper base element 24 with the ends of the fan blade tabs 38 that extend from the upper base element 24 being received by corresponding slots in the second group of slots 32 formed through the lower base element 26. The combined base elements 24 and 26 form an impeller base 43. The offset positions of the second group of slots 32 formed through the lower base element 26 relative to the first group of slots 30 formed through the upper base element 24 prevent radial movement of the fan blade 36 in an inward radial direction, thus locking the fan blade 34 into position upon the impeller base 43. The attachment of the lower base element 26 to the upper base element 24 may be with threaded fasteners, rivets, an adhesive, welding or any other conventional method of attachment. Thus, the tabs 38 on each of the fan blades 34 are keyed into the slots 30 and 32 formed through the upper and lower base elements 24 and 26. The radial outer edge of a retaining ring 44 that is attached to the upper base element 24 is received by the outer notch 40. The retaining ring 44 co-operates with the tabs 38 and slots 30 and 32 to retain the fan blades 34 upon the impeller base 43 when the impeller 12 is rotating at a high speed and the fan blades are being subjected to resulting centrifugal forces. Thus, the invention contemplates a method for fabricating of an impeller 12 without the need for welding the fan blades 34 to the impeller base 43, as is done in the prior art. Therefore, the cost and complexity of fabrication of the impeller is greatly reduced. Additionally, the risk of warping of the fan blades during welding is eliminated.

A conventional hub 46 is received by the base central aperture 28 and secured to the impeller base 43. The hub 46 provides a connection between the impeller 12 and a rotatable fan shaft (not shown). It is contemplated that the rotatable fan shaft would be carried by bearings mounted upon an external fan housing (not shown). However, the details of the supports for the fan shaft would depend upon the specific application. Pulleys and a drive belt, gears, or other conventional methods, such as direct coupling to a motor may be utilized to rotate the fan shaft.

While an impeller 12 for a double intake centrifugal fan 10 has been described and illustrated, the invention also may be utilized for a single intake fan impeller (not shown). While the single intake fan impeller in accordance with the invention would still require a pair of impeller base elements, only half of the slots would be needed.

Additionally, while the impeller 12 has been described and illustrated with radially extending fan blades 34, the invention also may be practiced with fan blades that are inclined forwardly or backwardly (not shown) from a radial direction by simply inclining the slots formed through the base elements. In a similar manner, the invention also may be practiced with curved fan blades (not shown) by forming curved slots (also not shown) though the impeller base elements. Finally, the invention may be practiced with a second group of slots 32 that are not formed with the end slots being equally spaced from the outer and inner edges of the base elements (not shown). The invention only requires that the first and second groups of slots be offset from one another to allow locking of the fan blades 34 in position upon the impeller base 43.

Figure 5:
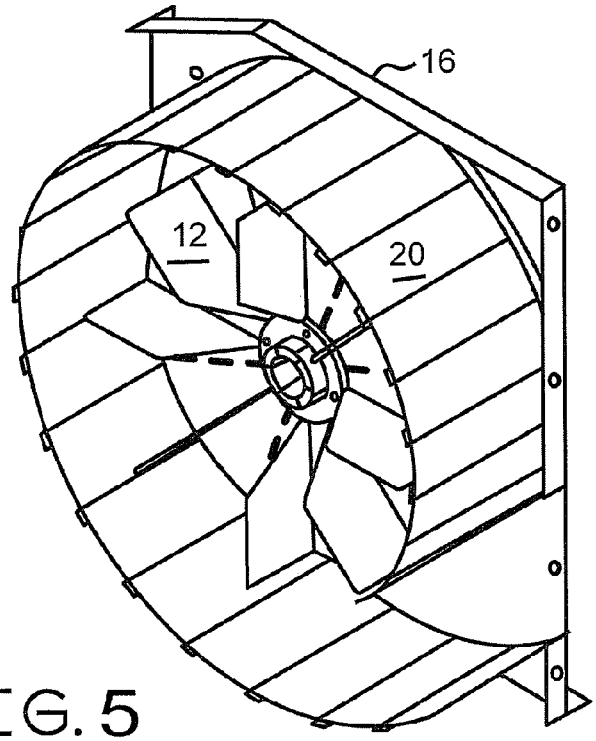
FIG. 5 is an isometric view that illustrates a volute sidewall that is included in the centrifugal fan shown in FIG. 1.

As described above and shown in FIG. 5, the centrifugal fan 10 also includes an air control casing 20 that surrounds the impeller 12. The air control casing 20 shown in FIG. 5 has a volute shape; however, the invention also contemplates using a casing having other shapes (not shown). The air control casing 20 defines a diffusion chamber that varies from a minimum volume to a maximum volume that is adjacent to an outlet portion of the casing 20. Thus, the air control casing 20 directs the air to the outlet duct 22.

Figure 6:
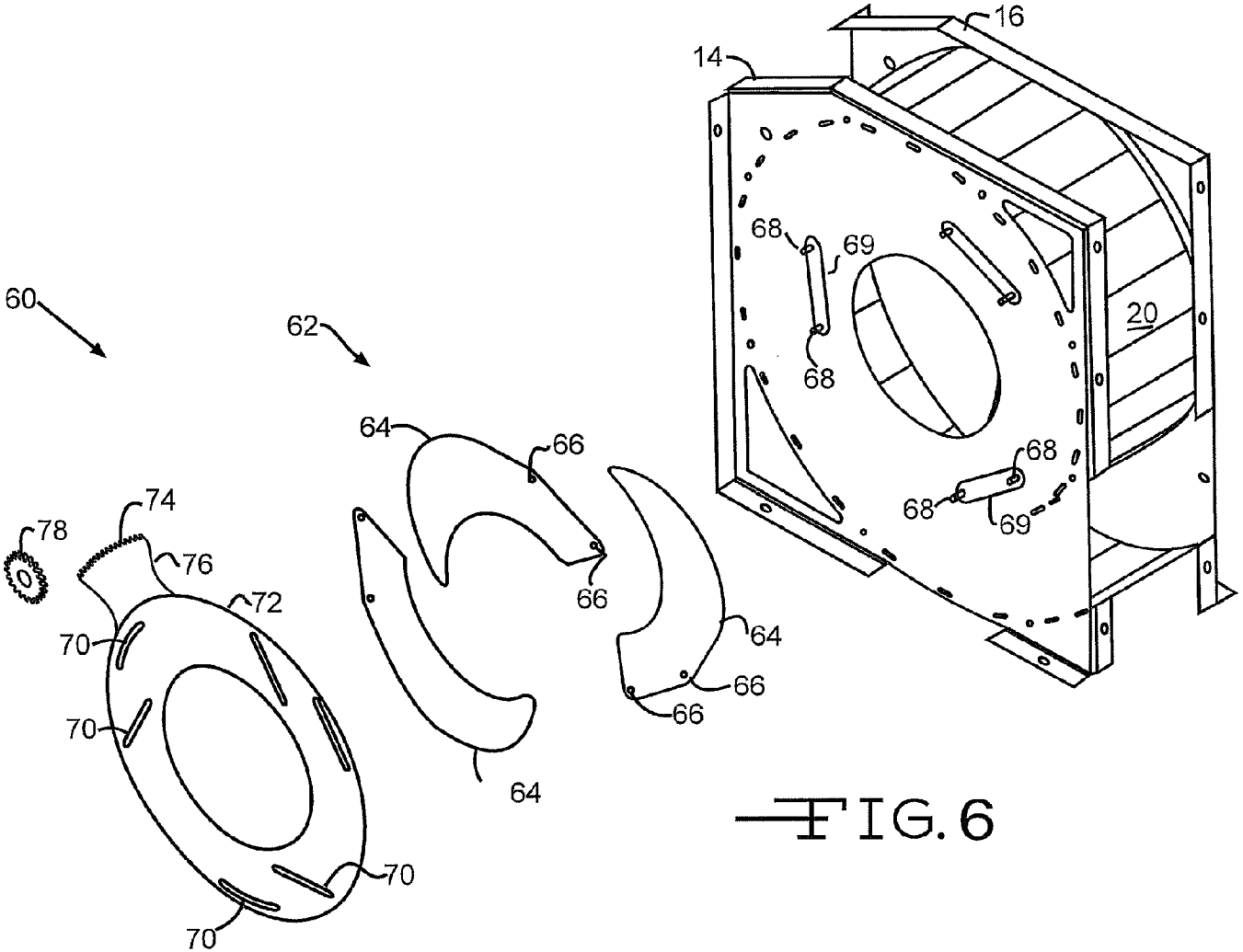
FIG. 6 is an exploded view of an air intake aperture that is included in the centrifugal fan shown in FIG. 1.
Figure 7:
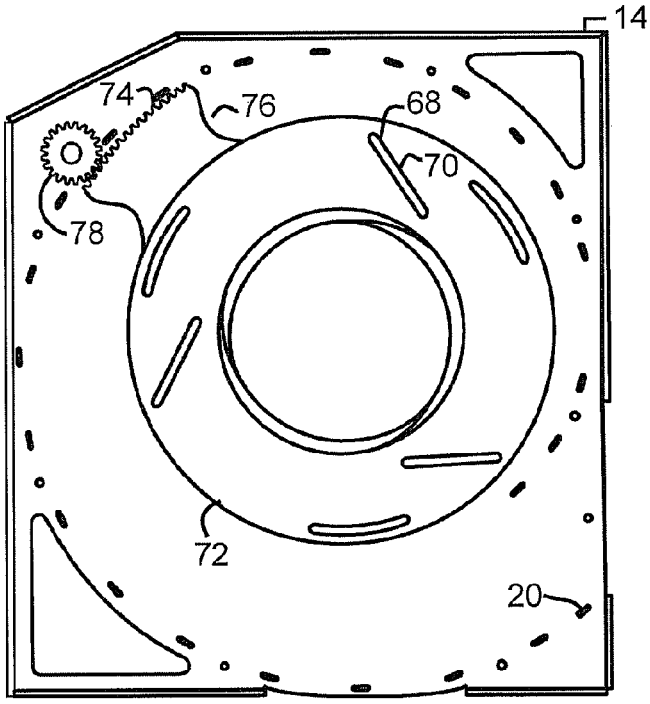
FIG. 7 illustrates the aperture shown in FIG. 6 in a fully open position.
Figure 8:
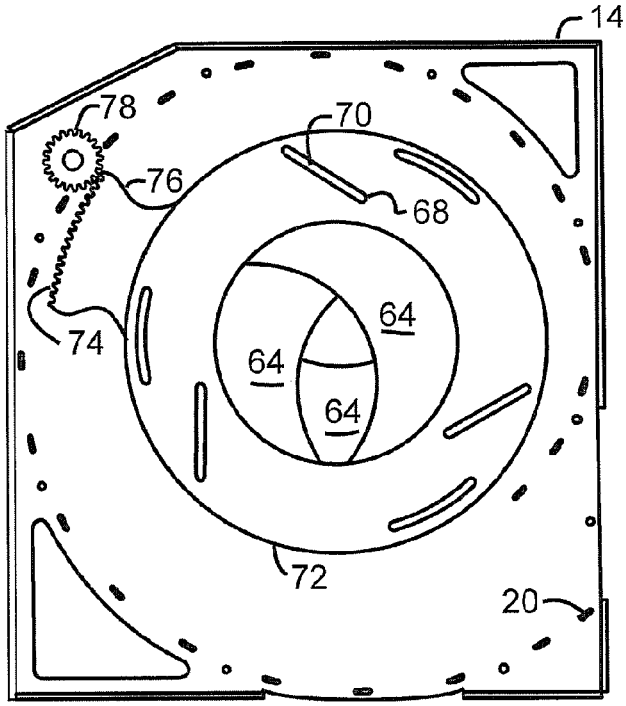
FIG. 8 illustrates the aperture shown in FIG. 6 in a fully closed position.

As also described above, an intake opening 18 is formed through each of the fan housing sidewalls 14 and 16; however only the opening in one of the sidewalls is illustrated in the Figs. A variable aperture 60 (one shown) is carried by each of the sidewalls 14 and 16 to control the amount of air drawn into the fan 10. An exploded view of the components included in the variable aperture 60 is shown in FIG. 6. The variable aperture 60 includes an iris diaphragm 62 having a plurality of overlapping curved blades 64. While three blades 64 are shown in FIG. 6, more or less blades may be utilized. Guide apertures 66 formed through the curved blades 64 receive guide pins 68 mounted upon respective carrier straps 69. The carrier straps 69 provide rigidity to the positioning of the guide pins 68. The carrier straps 69 may be attached to the inner surface of the curved blades 64 or merely held in position by the fan housing sidewall 14 as shown in FIG. 6. Each of the curved blades 64 is free to pivot about a pivot pin (not shown) that is attached to the housing side wall 14 and that extends through an aperture (also not shown) formed through the end of each blade 64 that is opposite from the end receiving the pins 68. The guide pins 68 extend through slots 70 formed through a control ring 72 that is disposed over the blades 64. A pinion gear 74 is formed upon an edge of a tab 76 that extends from the control ring 72. The pinion gear 74 is engaged by a spur gear 78. Rotation of the spur gear 78 causes the control ring 72 to rotate. As the control ring 72 rotates, the slots 70 co-operate with the guide pins 68 to move the blades 64 between an open position, as shown in FIG. 7, and a closed position, as shown in FIG. 8. It is noted that the impeller 12 has been omitted from FIGS. 7 and 8 for clarity.

While the invention has been described above as having a variable intake aperture, it is contemplated the invention also may be practiced with a variable discharge aperture (not shown) in lieu of the variable intake aperture. Such a variable discharge aperture would control the amount of air discharged from the fan 10 and may be mounted either within the outlet duct 22 or upon either end of the outlet duct. Alternately, the variable discharge aperture may be mounted at the discharge end of the volute shaped casing 20. The exact implementation of the variable discharge aperture would be selected to be compatible with the cross-sectional shape of the outlet duct 22 or the volute shaped casing 20. As an example, for the generally rectangular shape of the outlet duct 22 shown in FIG. 1, the variable discharge aperture may include a plurality of parallel louvers that may be opened or closed to increase or decrease, respectively, the flow of air from the outlet duct.

While the variable outlet aperture has been described as being used in lieu of the variable intake aperture, the invention also contemplates that the fan may include both a variable intake aperture and a variable discharge aperture (not shown) to allow better control of air. Additionally, the invention also may be practiced with neither a variable intake aperture nor a variable outlet aperture (not shown).

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A fan comprising:

a fan housing;

an impeller including a base rotatably disposed within said fan housing, said impeller base including a first base element having at least one slot formed therethrough and a second base element having at least one slot formed therethrough that is offset from said slot formed in said first base element when said base elements are arranged adjacent to one another; and at least one fan blade, said fan blade having a tab extending therefrom, said tab including a notch, said tab extending through said slot in said first base element with said notch engaging an end of said slot in said first base element, said tab also extending through said slot in said second base element with said second base element secured to said first base element to lock said fan blade in position upon said impeller base.

2. The fan according to claim 1 wherein said fan blade includes a plurality of notched tabs and further wherein each of said first and second base elements includes a plurality of slots for receiving said plurality of fan blade tabs.

3. The fan according to claim 2 wherein an aperture is formed through each of said first and second base elements and further wherein said apertures receive a hub adapted for attaching the impeller to a fan drive shaft.

4. The fan according to claim 1 including a plurality of fan blades mounted upon said impeller base.

5. The fan according to claim 4 wherein each of said fan blades extends outwardly in a generally perpendicular direction from both said first and second base elements to form a double impeller.

6. The fan according to claim 4 wherein each of said fan blades extends in a generally perpendicular direction from only said first base element to form a single impeller.

7. The fan according to claim 1 wherein said slots formed through each of said first and second base elements extends in a radial direction from a center of said base elements.

8. The fan according to claim 1 further including an air flow control casing disposed within said fan housing, said casing receiving said impeller and operative to direct an air flow generated by said impeller through an outlet opening formed through said fan housing.

9. The fan according to claim 8 wherein said air flow control casing has a volute shape.

10. The fan according to claim 8 wherein said fan impeller includes blades extending from both sides of said impeller base elements and further wherein two intake openings are formed through said fan housing to allow air to be drawn into the fan by both sides of said fan impeller.

11. The fan according to claim 10 further including a pair of adjustable intake apertures with each of said apertures having a variable opening, each of said intake apertures mounted upon said fan housing over one of said intake openings, said intake apertures operable to control the volume of air drawn into the fan by said impeller by varying the size of said variable openings.

12. The fan according to claim 1 wherein at least one intake opening is formed through said fan housing to allow air to be drawn into said fan housing by said impeller.

13. The fan according to claim 12 further including an adjustable intake aperture having a variable opening mounted upon said fan housing over said intake opening, said intake aperture operable to control the volume of air drawn into the fan by said impeller by varying the size of said variable opening.

14. The fan according to claim 12 further including an adjustable discharge aperture having a variable opening mounted upon said outlet opening of the fan, said aperture operable to control the volume of air discharged from the fan by said impeller.

15. A method for fabricating a fan comprising the steps of:

(a) providing at least one fan blade and first and second base elements, the fan blade having at least one notched tab extending therefrom and each base element having at least one slot formed therethrough, the slot formed through the first base element being offset from the slot formed through the second base element;

(b) inserting the fan blade tab through the slot formed through the first base element;

(c) sliding the fan blade across the first base element with the notch formed in the fan blade tab receiving the first base element;

(d) securing the second base element to the first base element with the fan blade tab extending into the slot formed through the second base element portion to form a fan impeller; and (e) rotatably mounting the fan impeller within a fan housing.

16. The method according to claim 15 wherein the fan housing includes an intake aperture formed therethrough for supplying air to the fan impeller and an outlet aperture formed therethrough for discharging a flow of air generated by rotating the impeller.

17. The method according to claim 15 wherein the fan impeller is placed within a volute shaped casing with both the fan impeller and the volute shaped casing being mounted within the fan housing.

* * * * *